United States Patent [19]

Serra et al.

[11] 4,453,857

[45] Jun. 12, 1984

[54] METHOD FOR STORING HAZARDOUS OR TOXIC WASTE MATERIAL

[76] Inventors: Gilbert M. Serra, 951 S. Hadley Rd., Ortonville, Mich. 48462; Larry Fortier, 7345 Shaker Dr. N., Pontiac, Mich. 48054; Ernest N. Valentino, 9365 Gibbs Rd., Clarkston, Mich. 48016

[21] Appl. No.: 301,455

[22] Filed: Sep. 14, 1981

Related U.S. Application Data

[63] Continuation-in-part of Ser. No. 68,529, Aug. 22, 1979, abandoned.

[51] Int. Cl.[3] ..... G21F 9/22

[52] U.S. Cl. ..... 405/128; 52/136; 52/281; 52/586; 405/129

[58] Field of Search ..... 166/305 D; 252/633; 405/52, 128, 129, 210; 52/128, 131, 136, 137, 138, 142, 281, 586

[56] References Cited

U.S. PATENT DOCUMENTS

| | | | |
|---|---|---|---|
| 2,783,523 | 3/1957 | Halley | 52/131 X |
| 2,882,564 | 4/1959 | Couse et al. | 52/586 X |
| 3,462,181 | 8/1969 | Lewis | 52/586 X |
| 3,601,943 | 8/1971 | Danois | 52/586 X |
| 3,705,851 | 12/1972 | Brauer | 405/129 X |
| 3,805,959 | 4/1974 | Mertens | 252/633 X |
| 3,855,809 | 12/1974 | Westling | 405/210 |
| 3,938,287 | 2/1976 | Gauchard | 52/131 X |
| 4,128,981 | 12/1978 | Juba | 52/128 X |
| 4,192,629 | 3/1980 | Hallenius et al. | 405/128 |
| 4,326,820 | 4/1982 | Uerpmann et al. | 405/128 |
| 4,350,461 | 9/1982 | Valiga et al. | 405/128 |
| 4,352,601 | 10/1982 | Valiga et al. | 405/128 X |
| 4,358,221 | 11/1982 | Wickberg | 405/128 |
| 4,362,434 | 12/1982 | Valiga et al. | 405/128 |

FOREIGN PATENT DOCUMENTS

| | | | |
|---|---|---|---|
| 40465 | 10/1973 | Australia | 405/52 |
| 5699 | of 1894 | United Kingdom | 52/128 |

*Primary Examiner*—Stephen J. Novosad
*Assistant Examiner*—George A. Suchfield
*Attorney, Agent, or Firm*—Fisher, Gerhardt, Crampton & Groh

[57] ABSTRACT

Hazardous or toxic waste material is permanently stored by sealing the material in sealed containers within an otherwise solid concrete block buried in the earth. A concrete chamber with integrated floor and side walls is formed in the ground. A first group of sealed, filled containers is arranged on the floor and covered with concrete. After the poured concrete has been cured, a second layer of containers is placed in the chamber and similarly encased in concrete. A final layer of concrete of substantial depth is poured atop the uppermost layer of containers to seal the chamber. Means can be provided to collect and recycle any leachate which escapes the concrete chamber providing additional safety.

7 Claims, 5 Drawing Figures

METHOD FOR STORING HAZARDOUS OR TOXIC WASTE MATERIAL

This case is a continuation-in-part of U.S. Ser. No. 068,529 filed Aug. 22, 1979, now abandoned.

In recent years, the disposal of hazardous or toxic waste materials has become a matter of rapidly increasingly public concern, and an increasing burden to governmental agencies and industrial concerns who must provide storage. Radioactive wastes which require long term storage and some shielding to absorb radiation are among the most commonly known wastes requiring storage. Many chemical by-products and spent reactants have been discovered to have hazardous effects beyond those originally appreciated. Examples of problem compounds are halogenated poly bisphenols, as well as, halogenated resins and solvents. Disposal methods employed in the past which allowed chemical leakage into human water supplies and animal food chains are now found to be not only inadequate, but highly dangerous. Only recently have the long term effects of improper disposal and resulting exposure to the toxic substrates become apparent. The acceptable limits of human exposure to halogenated organic compounds have been steadily decreased. To maintain acceptable exposure levels, improved storage techniques are required. Also the storage techniques should have backup systems which will function to collect any escaping materials in the case of a partial failure of the primary system.

Prior art systems have frequently allowed substantial leaching of contaminants into the surrounding soil or aquifers. Generally there has been no recovery mechanism associated with the disposal system and any recovery attempted was sporadic at best. The present invention is directed to the provision of a disposal method for storage of hazardous or toxic material. The system is designed to permanently confine the material to prevent its escape into the environment. The system can be furnished with a recovery system to collect and recover any leachate which by chance escapes confinement. The amount of leachate is minimized to assure the collection system can function at optimal levels.

Briefly, the present invention is directed to the storage of hazardous or toxic material which cannot be conveniently destroyed or rendered harmless. The waste is sealed in containers of uniform size which are subsequently embedded or encased in solid concrete buried within the earth. The encasing process commences with the formation of an open top concrete chamber within an excavation at an appropriate depth below ground level. A relatively thick concrete floor is formed with upwardly projecting side and end walls which rise to a suitable height above the floor. A layer of sealed, filled containers is then placed upon the floor of the chamber and concrete is poured into the chamber to fill the spaces between the containers and to fill the chamber to a depth greater than the height of the containers. When the poured concrete is set, its upper surface provides a second floor upon which is placed a second layer of filled, sealed containers, and the pouring, curing, and container placing steps are continued until the chamber is substantially filled. The final step of pouring concrete atop the structure, extend to form a substantially thick top. Safety or collection means are provided to monitor, trap and recapture any leakage of hazardous wastes.

Other objects and features of the invention will become apparent by reference to the following specification and to the accompanying drawings.

IN THE DRAWINGS

Figure 1:
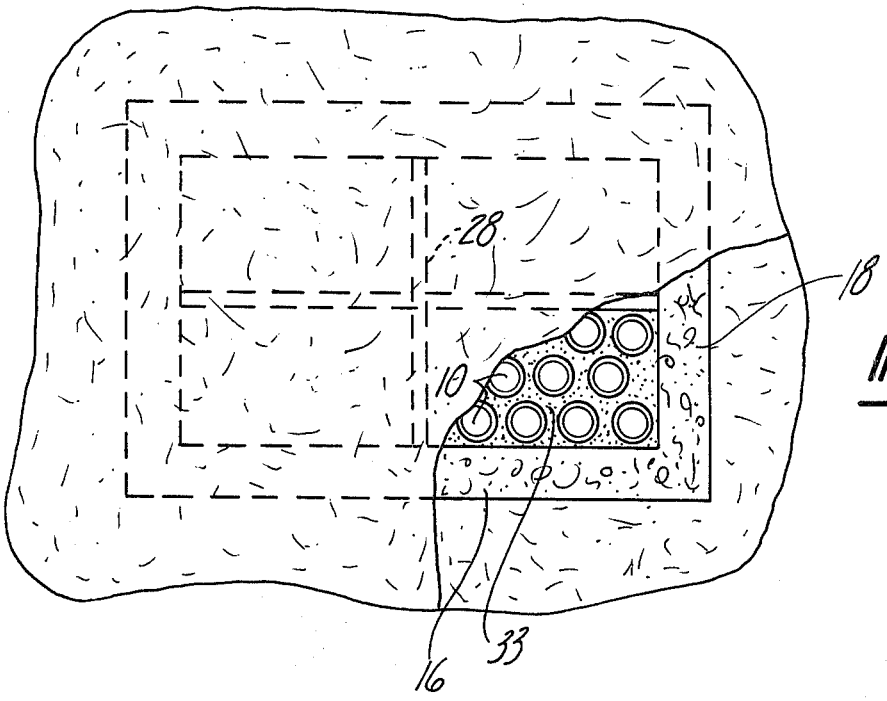
FIG. 1 is a plan view, partially broken away of a storage unit embodying the invention.

In practice of the present invention, hazardous or toxic material to be stored is first sealed into containers, preferably of uniform size, for transport to and handling at the disposal site. For many materials, the standard 55 gallon metal drum, 10 are entirely satisfactory. However, corrosive or highly radioactive materials will require containers of more specialized construction such as polymeric drums for corrosives and lead shielded containers for radioactive waste. The primary requirements of the containers employed are that the container possess adequate integrity to safely contain the particular material involved; and that the container possesses sufficient strength and rigidity to withstand the handling operations to which it will be subjected and the pressures applied by the static head of concrete as concrete is poured around and above the container during the storage process.

Details of each particular installation will vary in accordance with its location, soil conditions and type of waste being handled, however, the basic technique is to first form at a suitable depth below ground level an open topped concrete chamber. In a typical case, the chamber includes a floor 12 with a thickness of about three feet. The floor 12 has a continuous channel 14 formed around the outer edge of the floor. Continuous side 16 and end 18 walls of one or more feet thickness are poured to form the enclosed concrete chamber. The side and end walls 16, 18 are formed with a continuous bead 20 at the lower surface where the walls meet the floor. The bead 20 and channel 14 form a mechanical joint which serves to consolidate the chamber structure and prevent the movements of the parts relative to each other. A polymeric shield 22 is shown disposed within the joint. The shield has enlarged portions 24 which are disposed in the floor and walls thereby anchoring the shield within the chamber. The enlarged ends 24 are connected by a web 26 which passes transversely through the joint formed by the channel 14 and bead 20. The web 26 is essentially a continuous barrier which will minimize any leakage through the joint.

The side walls 16 and end walls 18 are poured with divider walls 28. The divider walls form compartments within the chamber. The chambers allow the storage of several kinds of hazardous material in the same chamber while keeping the materials separated. While the materials may react violently if mixed, this system will serve to prevent such dangers. The separation walls 28 also provide structural integrity to the chamber and provide support keeping the walls separated. Further, it is only necessary to fill one compartment with containers prior to encasement of the layer. Therefore, only about one forth of the chamber need be filled prior to encasement. This allows smaller lots of material to ensure the containerized waste is exposed to the surroundings for a shorter period of time prior to encasement which lessens the chance of an accident to one or more containers. As shown the divider walls 28 also have a mechanical joint with the floor.

The depth of the concrete container ground will be selected in accordance with the total number of containers 10 to be stored, which will also determine the height of the side and end walls, with provision being made for covering the completed installation with fill to an adequate depth.

The manner in which the floor, side and end walls are poured, the placing of reinforcing grids or bars within the poured material, etc. will be determined in accordance with standard construction practices, soil conditions, etc.

After the sides 16, floor 12 and end walls 18 have cured, containers 10 are placed on the floor of the chamber until the floor of one chamber is filled. In the usual case, the containers will be cylindrical and thus even when placed in side to side contact with each other, will provide spaces between the individual containers. In same cases, the properties of the waste material may be such that the containers will be located on the floor out of contact with each other, by distances determined by the property of the material or the container. In any case, it is desirable that spaces or voids be left between the containers as explained below.

After the containers 10 are placed on the floor 12, concrete is poured into the chamber to a depth which will cover the containers so as to form a floor for a subsequent layer of containers. Generally an amount which covers the container by three or more inches as shown at 30 will be sufficient. In the case where the material held in the container is of relatively low density a fixed grid of expanded metal or bars 32 can be secured to the chamber walls 16, 18 overlying the containers and preventing the containers from floating in the concrete as it is being poured. Where concrete rebar is used the retaining grid will serve the additional function of reinforcing the poured concrete. The concrete will fill the spaces between the containers as shown at 33 to form posts which support the subsequent layers of concrete and containers.

After the concrete has been poured to the desired depth, completely covering and enclosing the containers on the chamber floor, the concrete is allowed to cure and a second layer of containers is then placed on the new floor of the chamber and the process repeated until the final or uppermost layer of containers is placed. The final pouring which encases the upper layer of containers 10 will close the concrete chamber forming a ceiling 34. The ceiling will normally be of substantial thickness, e.g. say three feet or more. As shown, the ceiling has a bead and channel interlock with a shield 22 disposed therein to prevent leakage into as well as out of the chamber preventing or minimizing liquid percolation through and around the containers 10, lessening the amount of contaminate leachment. After the ceiling 34 has cured, fill dirt is employed to cover the installation.

Figure 2:
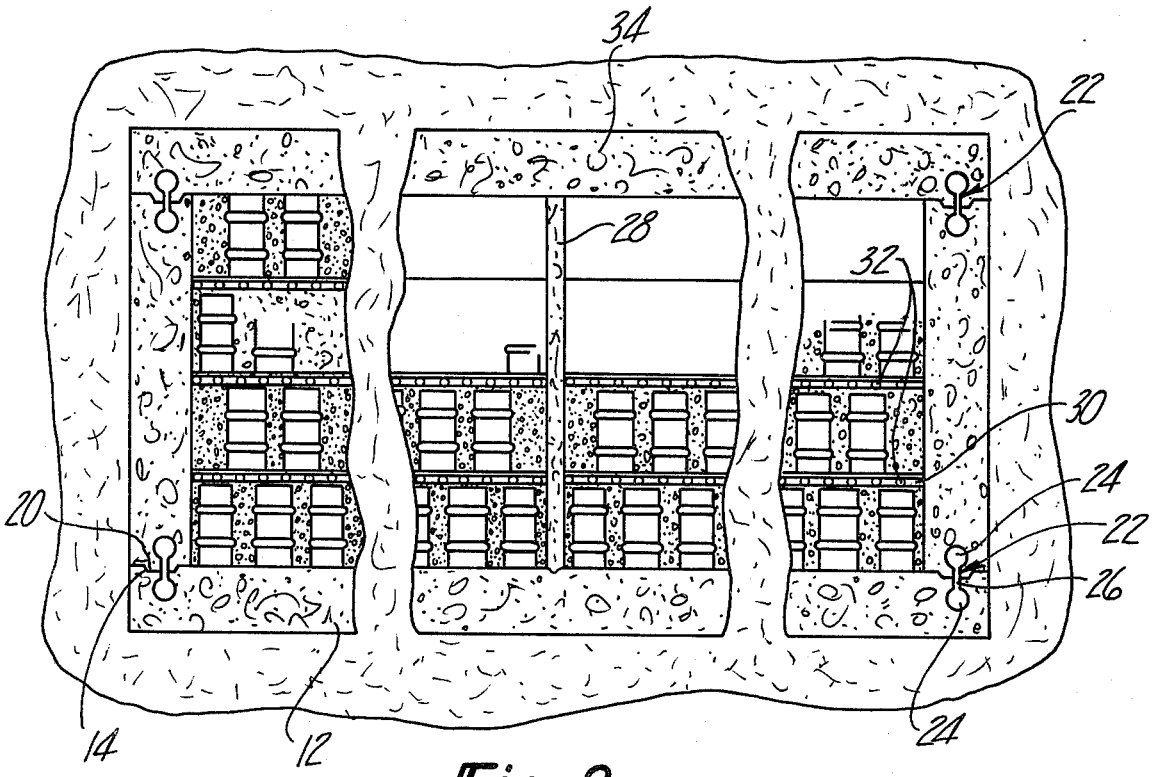
FIG. 2 is a cross-sectional view of the unit of FIG. 1.
Figure 3:
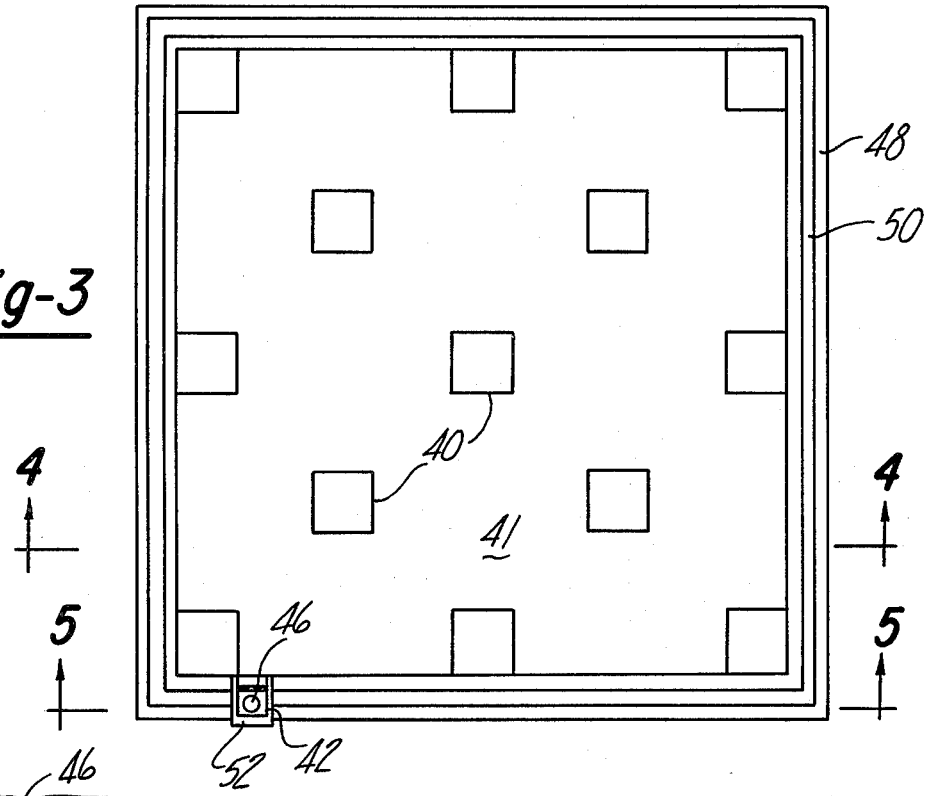
FIG. 3 is a plan view of a recovery system adapted to support a system as shown in FIG. 1.
Figure 4:
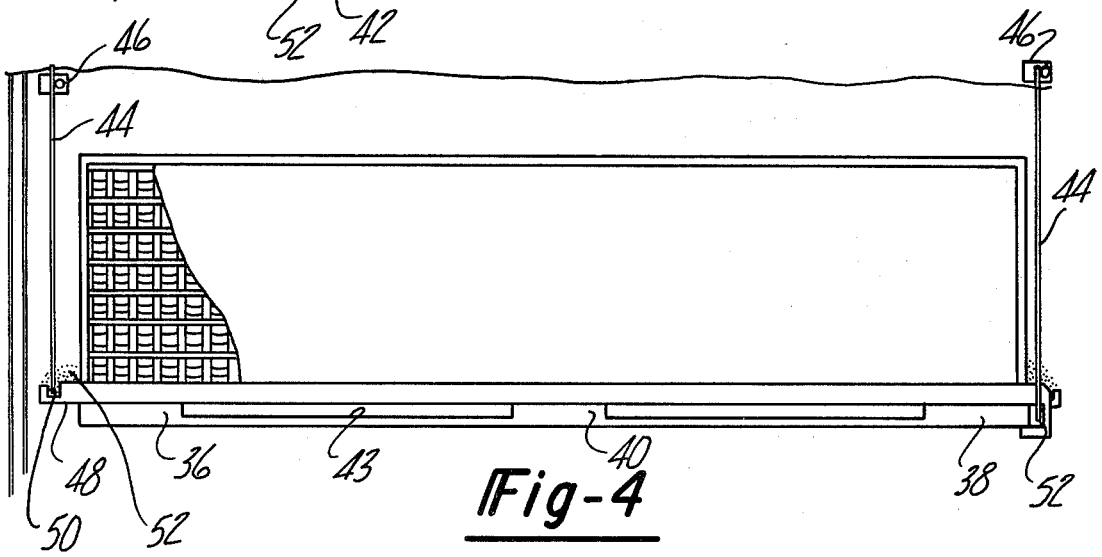
FIG. 4 is a side view, partially broken away of the structure of FIG. 1 on the base of FIG. 3.
Figure 5:
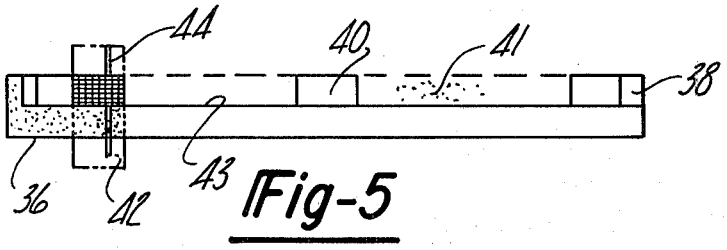
FIG. 5 is a side view of the recovery system of FIG. 3.

Referring now to FIGS. 3, 4 and 5, a recovery systems suitable for supporting the concrete chamber of FIGS. 1 and 2 described in detail hereinbefore is shown. A one-piece subfloor 36 is formed with short vertical walls 38 extending upward. A plurality of spaced concrete pillars 40 are formed extending upward from the floor 36 within the periphery of the walls to provide supporting columns. The volume between the pillars 40 is filled with crushed concrete, large gravel, or other course filler 41 material which provides a certain measure of load supporting strength but which is porous and will allow any liquid leachate coming from the bottom of the chamber to flow freely into the well level disposed below the upper surface of the floor.

A well 42 is shown formed at a location on the periphery of the floor 36. One or more of the wells 42 are formed as an integral part of the floor and depend downward from the floor to collect any leachate or liquid which escapes through the bottom or floor portion 12 of the concrete chamber. The upper surface 43 of the floor 36 will be shaped and slanted during construction so that any liquid on the upper surface flows to the well through the porous filler.

As shown, the well 42 has a pipe 44 contained therein which is attached to a pump 46 adapted to withdraw liquid and pump it to the surface where any liquid containing contaminants can be placed in a container for storage.

As shown in FIG. 4, the concrete chamber can be formed with a bottom wall which extends outward beyond the concrete chamber formed by the side walls 18 to form a shelf 48. The shelf 48 will have a recovery trench 50 formed as a continuous peripheral trench at a position several inches away from the walls. The recovery trench 50 and the area immediately above it would be back filled with crushed concrete or gravel 52 providing a porous media for several inches atop the recovery trench. Leachate, if any, from the concrete chamber will tend to flow down the walls into the porous gravel immediately above the shelf 48 and into the recovery trench 50. The trench is formed so that liquid therein drains into a lower recovery unit 52. Any leachate will be pumped to the surface by means of standard pumping techniques and the leachate processed and placed in suitable containers.

Monitors can be placed in the pipes extending into the recovery wells to monitor the liquid within the wells. Such monitors can be installed to monitor the presence of organic chemicals, acids, bases, or radioactivity depending upon the type or types of material stored within the concrete chamber. Such sensors are known in the art and the particular monitor forms no part of this invention.

With respect to the filler between the containers 10, alternative fillers can be used depending upon the material to be stored and the structural strength necessary. For example, the barrels can be surrounded with sand, aggregates, crushed rock or small stones which are tamped into a tight layer surrounding the containers. After the containers are surrounded with the crushed filler material, a layer of concrete of the desired thickness can be poured over the unit to create a sound solid structural floor for a second layer of containers with the process being repeated until the concrete chamber is full. The upper most layer of the unit forming the ceiling will be formed as described hereinabove with respect to FIGS. 1 and 2.

Where desired, one or more of the chambers formed by the divider walls, side walls, end walls and floor can be sprayed with sealing materials. One example of a suitable sealing material is an isocyanate terminated polyurethane prepolymer. Such polymers have polyoxyethylene as a backbone prepolymer the polymers being miscible and reactive with water. Such polymers when sprayed on concrete have a tendency to be absorbed into the liquid generally present in concrete and react in situ with the ambient water to form a polyureaurethane which seals the porous concrete. Other coating materials such as asphalt, and various other polymeric sealant materials are known in the art. Obviously, if so desired, the outer surface of the concrete chamber could be coated instead of the inner or both the inner and the outer surfaces could be coated with the same or different materials depending upon the desired structure. Examples of other suitable coating materials are polysulfide-epoxide resins, chloro-sulfonate polyethylene, polyvinyl chloride, polyvinyl acetate, lead metal, and polyethylene sheeting.

Another structural material suitable for use in the practice of this invention is a material called polymeric concrete. Such structural material improves the durability and water-tightness of concrete structures and improves the concrete's resistance to corrosive environment. The material also provides improved strength and stiffness. In forming polymeric concrete, an organic monomer system is mixed into the concrete in addition to the water used in mixing the cement. One example of a suitable monomer system is methacrylate combined with trimethlopropane, trimethacrylate and azo bis-isobutyronitrile. Such a system will cure to a polymerized methylemthacrylate system which seals and consolidates the concrete or portland cement present in the concrete chamber. Examples of other suitable chemicals include trimethacrylate, dimethyl para toluidine. Such resin systems and suitable free radical catalysts are known in the art. As noted before, various isocyanate terminated polymers and prepolymers, urethanes or epoxides, can be added to the concrete mixture prior to pouring to provide materials which will react in situ to form a polymer within the concrete sealing the pores and preventing or at least minimizing, the flow of liquid into and out of the chamber.

Various modifications and alterations of this invention will become apparent to those skilled in the art from the description of the new waste disposal system contained hereinbefore. It is understood that this invention is not limited to the illustrative embodiments described hereinbefore.

What is claimed is:

1. The method of storing hazardous waste material comprising the steps of: sealing the material in rigid cylindrical containers of uniform size; forming an open topped chamber of concrete at a substantial depth in the earth having a floor with a continuous peripheral channel formed therein, and continuous side and end walls; said floor having a shelf projecting beyond said side walls and said end walls, said shelf having a recovery trench formed therein said recovery trench being adapted to receive leachate from the concrete chamber, said trench having a well adapted to receive the leachate; a pump means adapted to remove leachate to the surface for further treatment; said continuous side and end walls are formed with a bead which interlocks with said channel, said side and end walls projecting from the floor by a distance exceeding the height of a container; standing a group of filled, sealed containers on end upon said floor in a spaced non-touching relationship; placing a fixed grid in an overlying relationship to said containers said grid being attached to said side walls to maintain said containers in position; subsequently pouring concrete into said chamber to a depth exceeding the height of said containers by at least three inches to thereby completely encase said containers; and pouring a final layer of concrete atop the chamber, said final layer extending outward to form a top on a said chamber, said top having a mechanical locking arrangement with the upper surface of said side walls.

2. The method of claim 1 further comprising of the steps of standing a second group of containers on the concrete poured into said chamber after said concrete has cured, and repeating the step of pouring concrete into said chamber to fill the spaces between the containers of the second group to a depth exceeding the height of said containers by at least three inches to completely encase said containers.

3. The method of claim 1 wherein said concrete chamber has divider walls transversing the chamber so as to divide the concrete chamber into a plurality of chambers.

4. The method of claim 1 wherein said concrete chamber is formed atop a leachate recovery system underlying and supporting the floor of said concrete chamber said recovery system comprising: a floor member having short vertical walls extending upward therefrom to form an enclosed recovery chamber; a plurality of supporting columns formed integrally with said floor and extending upward from said floors said columns having a spaced relationship; porous filler material disposed within the void volume of said recovery chamber; a recovery well in fluid communication with said recovery chamber adapted to recover and hold leachate from said concrete chamber; and pump means adapted to remove leachate from said well and move the leachate to a processing station for recovery.

5. The method of claim 1 wherein the walls of said concrete chambers are coated with a sealing material.

6. The method of claim 1 wherein the concrete chamber is formed of polymeric concrete.

7. The method of claim 1 wherein the mechanical joints between the chamber's walls and the floor have a polymeric barrier transversely disposed across said joint, said barrier having enlarged portions which is firmly surrounded and entrapped by the walls and floor.

* * * * *